US011400323B2

(12) United States Patent
Bernstein et al.

(10) Patent No.: US 11,400,323 B2
(45) Date of Patent: Aug. 2, 2022

(54) PROTECTIVE FACE COVERINGS

(71) Applicant: Sleevz, Inc., Birmingham, AL (US)

(72) Inventors: Julianne Bernstein, Birmingham, AL (US); Scott Joseph Bernstein, Birmingham, AL (US)

(73) Assignee: SLEEVZ Inc., Birmingham, AL (US)

( * ) Notice: Subject to any disclaimer, the term of this patent is extended or adjusted under 35 U.S.C. 154(b) by 0 days.

(21) Appl. No.: 17/102,601

(22) Filed: Nov. 24, 2020

(65) Prior Publication Data

US 2021/0393996 A1 Dec. 23, 2021

Related U.S. Application Data

(60) Provisional application No. 63/045,855, filed on Jun. 30, 2020, provisional application No. 63/040,330, filed on Jun. 17, 2020.

(51) Int. Cl.
*A62B 18/08* (2006.01)
*A41D 13/11* (2006.01)
(Continued)

(52) U.S. Cl.
CPC ..... *A62B 18/084* (2013.01); *A41D 13/1107* (2013.01); *A41D 13/1161* (2013.01);
(Continued)

(58) Field of Classification Search
CPC ..... A62B 18/084; A62B 7/10; A62B 18/025; A62B 23/02; A62B 9/04; A62B 17/001;
(Continued)

(56) References Cited

U.S. PATENT DOCUMENTS 1,279,884 A 9/1918 La Roche
3,298,031 A 1/1967 Morgan
(Continued)

FOREIGN PATENT DOCUMENTS

CN 2657711 Y 11/2004
CN 205848757 U 1/2017
(Continued)

OTHER PUBLICATIONS

AsiaOne, "I try a viral mask-wearing hack for people who wear glasses. Here's why I won't recommend it," published May 20, 2020, available at https://www.asiaone.com/lifestyle/i-tried-viral-mask-wearing-hack-people-who-wear-glasses-heres-why-i-wouldnt-recommend-it.

(Continued)

*Primary Examiner* — Kendra D Carter
*Assistant Examiner* — Arielle Wolff
(74) *Attorney, Agent, or Firm* — Bradley Arant Boult Cummings LLP

(57) ABSTRACT

Face coverings that protect the facial T-Zone region (i.e., eyes, nose, and mouth) from airborne transmission of infectious and other harmful particles are disclosed. The face coverings disclosed herein are designed to attach to the temples, frames, and/or the bridge of eyewear, which provides protection for the eyes of the wearer and dispenses of the need to adjust straps traditionally found on face masks. The face coverings may be converted to different configurations depending on the amount of protection and comfort desired by the wearer. For example, the face coverings disclosed herein can convert from a free-hanging position to a more protective configuration in which the mask conforms closely to the face of the wearer.

14 Claims, 14 Drawing Sheets

(51) Int. Cl.

| | |
|---|---|
| ***A62B 18/02*** | (2006.01) |
| ***A62B 7/10*** | (2006.01) |
| ***A41D 31/30*** | (2019.01) |
| ***A62B 23/02*** | (2006.01) |

(52) U.S. Cl.
CPC ..... *A41D 31/30* (2019.02); *A62B 7/10* (2013.01); *A62B 18/025* (2013.01); *A62B 23/02* (2013.01)

(58) Field of Classification Search
CPC .. A62B 18/082; A41D 13/1161; A41D 31/30; A41D 13/1107; A41D 13/1184; A41D 13/1115; A41D 13/11; A41D 13/1176; A61F 9/04; A45D 44/12; A61M 16/06
See application file for complete search history.

(56) References Cited

U.S. PATENT DOCUMENTS

| | | | | | |
|---|---|---|---|---|---|
| 3,768,100 | A * | 10/1973 | Colman | A41D 13/1161 | 2/9 |
| 4,796,621 | A | 1/1989 | Barle et al. | | |
| 4,843,643 | A | 7/1989 | Parissenti et al. | | |
| 4,944,039 | A | 7/1990 | Dietrich | | |
| 4,944,294 | A | 7/1990 | Borek, Jr. | | |
| 5,424,787 | A * | 6/1995 | Zegarelli | A41D 13/1161 | 2/429 |
| 5,584,078 | A | 12/1996 | Saboory | | |
| 5,704,063 | A * | 1/1998 | Tilden | A41D 13/1161 | 2/427 |
| 5,732,410 | A * | 3/1998 | Machson | A61F 9/02 | 2/9 |
| 5,956,119 | A | 9/1999 | Gibbs | | |
| 6,026,511 | A | 2/2000 | Baumann et al. | | |
| 6,085,748 | A | 7/2000 | Sword et al. | | |
| 7,077,128 | B2 | 7/2006 | Wilson et al. | | |
| 7,488,068 | B2 * | 2/2009 | Welchel | A41D 13/1184 | 2/8.2 |
| 7,637,611 | B1 | 12/2009 | Rotella | | |
| 7,677,724 | B1 | 3/2010 | Erickson et al. | | |
| 8,387,163 | B2 | 3/2013 | Beliveau | | |
| D697,546 | S | 1/2014 | Seo | | |
| D834,755 | S | 11/2018 | Schempp | | |
| 10,357,672 | B2 | 7/2019 | Bora | | |
| 10,575,514 | B1 * | 3/2020 | Sasaki | A41D 13/001 | |
| 2003/0217751 | A1 * | 11/2003 | Patrick | A41D 13/1161 | 128/205.27 |
| 2004/0118405 | A1 * | 6/2004 | Amante | A41D 13/1161 | 128/206.19 |
| 2005/0172968 | A1 * | 8/2005 | Hishida | A41D 13/1192 | 128/206.19 |
| 2005/0172986 | A1 * | 8/2005 | Lu | A45B 3/04 | 135/33.2 |
| 2007/0252946 | A1 * | 11/2007 | Welchel | A61F 9/029 | 351/62 |
| 2012/0240943 | A1 | 9/2012 | Edwards | | |
| 2014/0196187 | A1 | 7/2014 | Beliveau | | |
| 2014/0196200 | A1 | 7/2014 | Beliveau | | |
| 2014/0259253 | A1 * | 9/2014 | Jacob | A41D 13/1184 | 2/15 |
| 2016/0213959 | A1 * | 7/2016 | Barklow | A41D 13/1107 | |
| 2017/0251748 | A1 * | 9/2017 | Imppola | A42B 5/00 | |
| 2018/0311515 | A1 * | 11/2018 | Wilson | A61B 5/6803 | |
| 2020/0121005 | A1 * | 4/2020 | Belousov | A41D 13/1107 | |
| 2021/0022418 | A1 * | 1/2021 | Furuya | A41D 13/1161 | |
| 2021/0052426 | A1 * | 2/2021 | Gruber Reif | A42B 3/105 | |

FOREIGN PATENT DOCUMENTS

| | | | | | |
|---|---|---|---|---|---|
| CN | 208002145 | U | | 10/2018 | |
| CN | 109730830 | A | | 5/2019 | |
| CN | 210248483 | U | | 4/2020 | |
| DE | 202020001709 | | * | 5/2020 | A41D 13/113 |
| DE | 202020001858 | | * | 6/2020 | A62C 18/082 |
| JP | 2004202118 | | | 7/2004 | |
| JP | 2007044464 | | | 2/2007 | |
| JP | 2007044465 | | | 2/2007 | |
| JP | 3153206 | U | | 8/2009 | |
| JP | 5066029 | | | 11/2012 | |
| JP | 3203761 | U | | 4/2016 | |
| KR | 200204676 | Y1 | | 12/2000 | |
| KR | 200420156 | Y1 | | 6/2006 | |
| KR | 101172296 | | | 8/2012 | |
| KR | 101405510 | | | 6/2014 | |
| KR | 102042842 | | | 11/2019 | |
| WO | 89/10106 | | | 11/1989 | |
| WO | 2016032228 | | | 3/2016 | |
| WO | WO-2021219235 | A1 | * | 11/2021 | A41D 13/1115 |

OTHER PUBLICATIONS

International Search Report and Written Opinion dated Aug. 30, 2021 of corresponding International Patent Application No. PCT/US2021/036921.

* cited by examiner

PROTECTIVE FACE COVERINGS

FIELD OF THE DISCLOSURE

The present disclosure relates generally to wearable face protection, and more particularly to a face covering that is attachable to eyewear for protecting the eyes, nose, mouth, and chin of the wearer.

BACKGROUND

There are a number of airborne particles (for example, infectious microbial particles, respiratory droplets, dust particles, and pollutants) that are dangerous to humans when the particles are inhaled or exposed to the conjunctiva of the eyes. Viral infectious diseases, such as human respiratory tract infections, can be particularly dangerous for humans when the infectious particles enter the body. Examples of viral causes of infectious diseases (and their associated diseases) include the novel coronavirus (COVID-19); human coronavirus (SARS); Influenza A virus (including swine flu); Influenza B-C virus (coryza; 'common cold'); Human adenovirus A-C (various respiratory tract infections; pneumonia); Mumps virus (epidemic parotitis); Rubeola virus (measles); Rubella virus (German measles); Human respiratory syncytial virus (RSV) (coryza; 'common cold'); variola virus (smallpox); varicella-zoster virus (herpes virus) (chickenpox); Bordetella pertussis (whooping cough); Neisseria meningitidis (meningitis); Mycobacterium tuberculosis (tuberculosis); and Streptococcus pyogenes/pneumoniae (strep throat, meningitis, pneumonia).

Among the modes of transmission of these infectious human diseases are by airborne and aerosol transmission of infectious particles expelled from the respiratory tract of an infected person by coughing or sneezing, or by simple exhalation, and into the gastrointestinal or respiratory systems of a previously non-infected person by inhalation. The conjunctiva of the eye is also easily exposed to infectious droplets during close contact with infected individuals and contaminated hands. To combat these forms of transmission, facial masks and protective eyewear have been developed that intercept the infectious particles by a variety of mechanisms.

With the recent spread of the particularly contagious and infectious disease, COVID-19, governments around the world have issued mask mandates requiring citizens to wear facial masks and coverings in public. Protective face masks are designed to be worn by both the infected person to prevent transmission of infection, and by the non-infected person to prevent being infected. However, adherence to these mask mandates by the general public is often limited due to the problems associated with traditional face masks. For instance, many people find it difficult to breathe or communicate while wearing a traditional face covering or mask. Others find that traditional face coverings or masks irritate the skin and are uncomfortably hot to wear while outdoors in warmer climates. Moreover, many of the traditional face coverings and masks require the use of straps either behind the ears or the head as a means for securing the face covering or mask to the wearer. Many people find themselves having to constantly adjust their mask or mask strap to reduce pain, improve the fit of the mask, or prevent the mask from falling below the nose, which often leads to the placement of even more germs in and around the eyes, nose, and mouth of the wearer. Many masks also cause fogging when worn with eyewear, such as glasses. Finally, many of the traditional masks currently on the market only provide protection for the nose and mouth of the wearer and do not offer protection for the eyes.

Accordingly, there remains a need in the art for a more comfortable, anti-fog, breathable face covering or mask that can connect to eyewear to protect the entire facial T-Zone region (i.e., eyes, nose, and mouth) of the wearer from airborne transmission of infectious and other harmful particles and that can be worn by a user without the need for constant adjustment.

SUMMARY

Face coverings that protect the facial T-Zone region (i.e., eyes, nose, and mouth) from airborne transmission of infectious and other harmful particles are disclosed. The face coverings disclosed herein are advantageously designed to attach to the temples, bridge, and/or frames of eyewear, which provides protection for the eyes of the wearer and dispenses of the need to adjust straps traditionally found on face masks. In some embodiments, a protective face covering is disclosed, the protective face covering including a mask piece adapted to cover a user's nose, mouth, and chin, wherein the mask piece includes a first attachment mechanism configured to attach the mask piece to eyewear having a first temple and a second temple, wherein the first attachment mechanism includes at least one of: a pair of sleeves configured for receiving each temple of the eyewear and a pair of clips configured for hooking onto each temple of the eyewear; and a second attachment mechanism configured to releasably couple the mask piece under the user's chin.

In one embodiment, the second attachment mechanism includes a first magnetic element and a second magnetic element, the first and second magnetic elements configured to magnetically couple the mask piece under the user's chin. In another embodiment, the second attachment mechanism includes a first hook and loop fastener and a second hook and loop fastener, the first and second hook and loop fasteners configured to fasten the mask piece under the user's chin. In still another embodiment, the second attachment mechanism includes a drawstring configured to adjustably fasten the mask piece under the user's chin. In yet another embodiment, the second attachment mechanism includes one or more loops configured to attach to each temple of the eyewear for securing the mask piece. The mask piece may further include an eyewear coupler, the eyewear coupler configured to couple the eyewear to the mask piece. In other embodiments, the mask piece is formed of a material selected from the group consisting of cotton, wool, silk, polyester, neoprene, cellulosic fiber, glass fiber, mineral fibers, nylon fiber, acrylonitrile fiber, plastic, spunbond nonwoven polypropylene fiber (SBPF), melt blown polypropylene fiber (MBPF), and combinations thereof. The mask piece may also include an antimicrobial agent selected from the group consisting of biquanides, phenols, phenol derivatives, isothiazolones, metals, ammoniums, alcohols, and combinations thereof, or an antiviral agent selected from the group consisting of oseltamivir phosphate, zanamivir, peramivir, baloxavir marboxi, amantadine, rimantadine, and combinations thereof.

In other embodiments, a protective face covering is disclosed, the protective face covering including a mask piece adapted to cover a user's nose, mouth, and chin, where the mask piece includes a first side panel and a second side panel; a first attachment mechanism configured to attach the mask piece to a left temple and a right temple of eyewear, wherein the first attachment mechanism includes a first sleeve positioned at a top edge of the first side panel and a second sleeve positioned at a top edge of the second side panel, the first and second sleeves configured for receiving each temple of the eyewear; and a second attachment mechanism configured to releasably couple the mask piece around at least one of the user's chin and the user's neck, wherein the second attachment mechanism includes a first magnetic element in the first side panel and a second magnetic element in the second side panel. The first sleeve and the second sleeve may be integrally formed with the mask piece.

In this embodiment, the mask piece includes a bendable nose grip. The mask piece may further include an eyewear coupler, the eyewear coupler including a magnet for magnetically coupling the eyewear to the mask piece. In another embodiment, the mask piece has an interior surface, the interior surface including a slot configured for insertion of a filter selected from an activated carbon filter, a high efficiency particulate air (HEPA) filter, or a combination thereof. In still another embodiment, the mask piece is formed of at least one layer of a material selected from the group consisting of cotton, wool, silk, polyester, neoprene, cellulosic fiber, and combinations thereof. In other embodiments, the mask piece is formed of a transparent plastic material selected from the group consisting of polyethylene, polypropylene, polycarbonate, acrylic, and PETG. The transparent plastic material may include a fog-resistant coating.

In still other embodiments, a protective face covering is disclosed, the protective face covering including eyewear adapted for protecting a user's eyes, wherein the eyewear comprises a left temple, a right temple, a bridge, and at least one lens frame; a mask piece adapted to cover the user's nose, mouth, and chin, wherein the mask piece includes a first side panel, a second side panel, and a center panel; a first attachment mechanism configured to attach the mask piece to at least one of: the left temple, the right temple, the bridge, and the at least one lens frame, wherein the first attachment mechanism comprises a fastener configured to couple to a corresponding fastener on the left temple, the right temple, the bridge, the at least one lens frame, or combinations thereof; and a second attachment mechanism configured to releasably couple the mask piece under the user's chin, wherein the second attachment mechanism includes a first magnetic element in a bottom portion of the first side panel and a second magnetic element in a bottom portion of the second side panel.

In one embodiment, the center panel of the mask piece further comprises a nose grip. In another embodiment, the fastener and the corresponding fastener include a magnet or a hook and loop fastener. In still another embodiment, the mask piece is further adapted to extend and cover the user's ears and neck.

BRIEF DESCRIPTION OF THE DRAWINGS

Further features and advantages can be ascertained from the following detailed description that is provided in connection with the drawings described below.

DETAILED DESCRIPTION

Figure 1A:
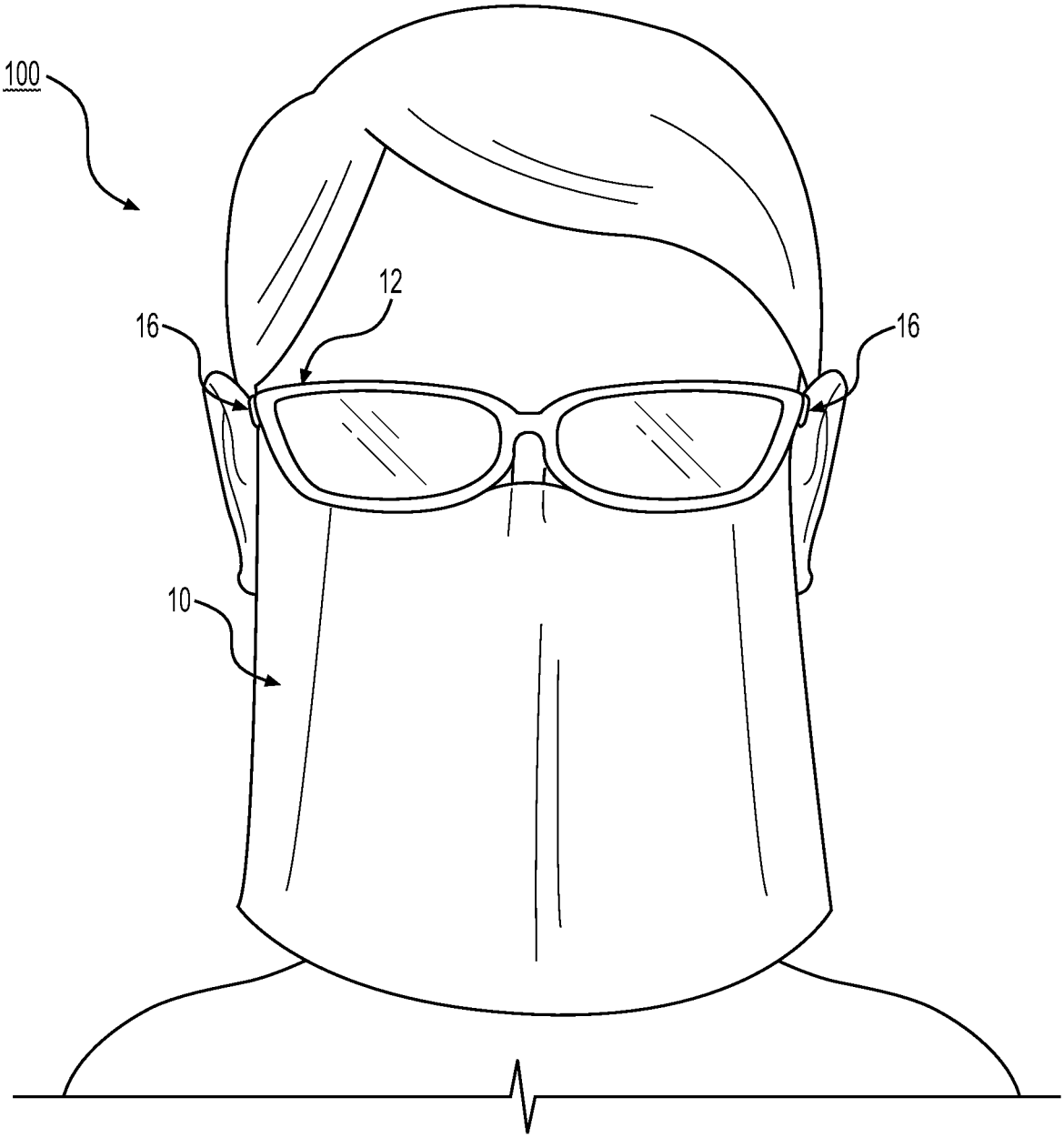
FIG. 1A is a front view of a face covering according to an embodiment of the present disclosure.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

Spatially relative terms, such as "under," "below," "lower," "over," "upper," and the like, may be used herein for ease of description to describe one element or feature's relationship to another when the apparatus is right side up as shown in the accompanying drawings.

The terms "first," "second," "third," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

The present disclosure provides a face covering that protects the entire facial T-Zone region (i.e., eyes, nose, and mouth) of the wearer from airborne transmission of infectious and other harmful particles. The face coverings of the present disclosure are configured to attach to the temples, bridge, or frames of eyewear, which provides protection for the eyes of the wearer and dispenses of the need to adjust straps traditionally found on face masks to improve the fit of the mask. The face coverings of the present disclosure may also be converted to different configurations depending on the amount of protection and comfort desired by the wearer. For example, the face coverings of the present disclosure may convert from a free-hanging position to a more protective cup-shaped configuration in which the mask conforms closely to the face of the wearer.

Figure 1B:
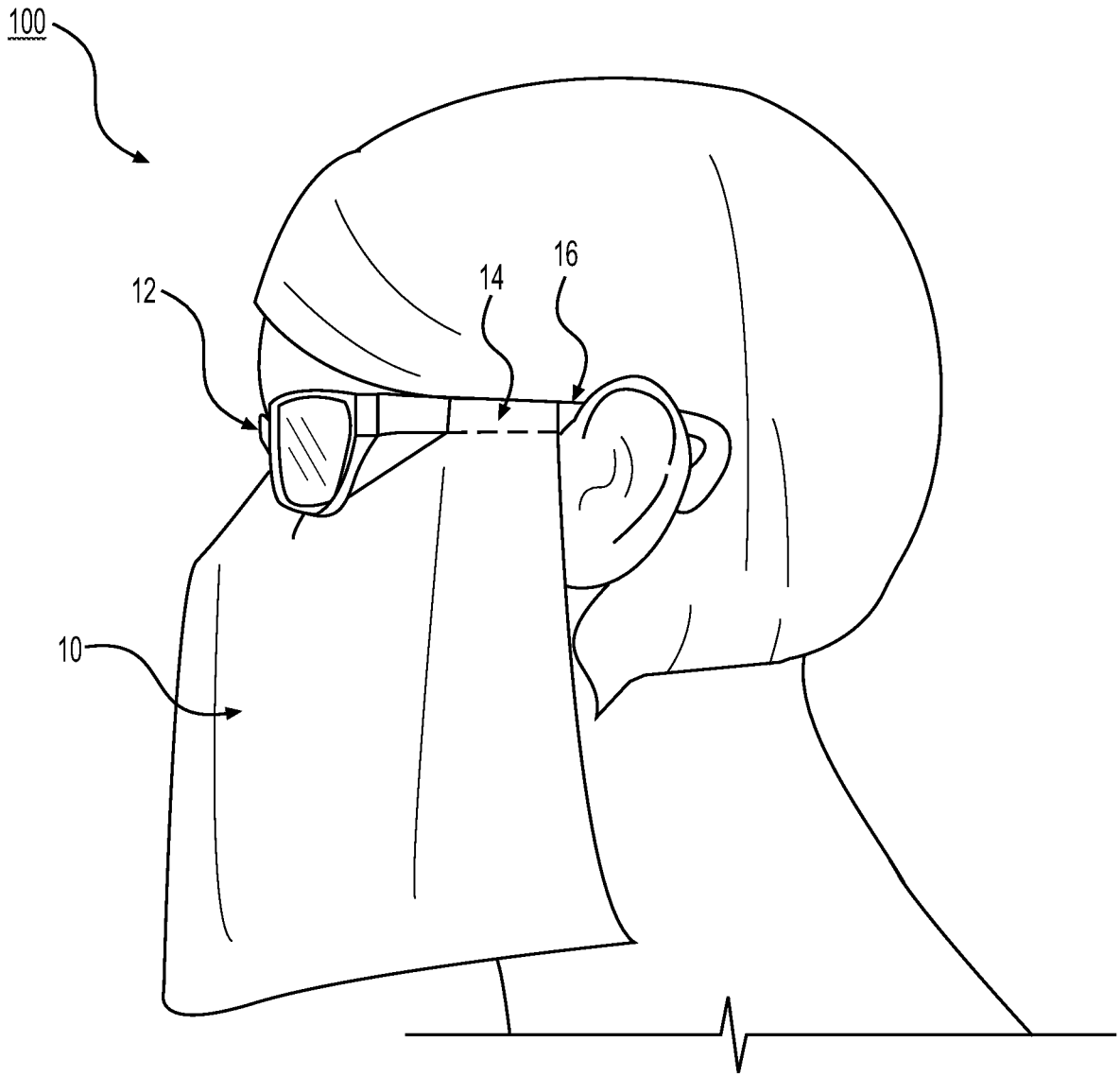
FIG. 1B is a side view of the face covering shown in FIG. 1A.

Referring to FIGS. 1A and 1B, a face covering 100 according to one embodiment of the present disclosure is shown. The face covering 100 includes a mask piece 10 adapted to fit over the nose, mouth, and chin of the wearer and to conform closely to the face to protect the wearer from airborne contaminants. As shown in FIGS. 1A and 1B, the mask piece 10 is free-hanging and drapes over the face of the wearer to provide comfort and breathability while still offering protection from harmful airborne contaminants.

In one embodiment, the mask piece 10 may be worn by securing the mask piece 10 to protective eyewear 12. As used herein, "protective eyewear" may refer to eyeglasses, sunglasses, goggles, safety glasses, or other objects worn over the eyes. In this embodiment, the mask piece 10 includes an attachment mechanism for securing the mask piece 10 to the protective eyewear 12. In the illustrated embodiment, the mask piece 10 includes a pair of sleeves 14 for receiving each temple 16 of the protective eyewear 12. The sleeves 14 may be configured to allow each temple 16 to slide in and out of the sleeve 14 to securely attach the mask piece 10 to the protective eyewear 12. By securely attaching the mask piece 10 to the temples 16 of the protective eyewear 12, the mask piece 10 remains in place such that the wearer does not need to adjust any straps or loops, which helps prevent the wearer from touching their face and spreading potentially harmful germs. The attachment of the mask piece 10 to the temples 16 also helps to remove pressure from the ears and face of the wearer. In some embodiments, the temples 16 may include a temple tip (not shown) that may slide onto the temple 16 for securing the mask piece 10 and/or the protective eyewear 12.

In the illustrated embodiment, the sleeves 14 are integrally formed with the mask piece 10. In other embodiments, the sleeves 14 may be formed separately and attached to the mask piece 10 by, for instance, stitching, sewing, threading, or other types of fasteners. The sleeves 14 may be rectangularly shaped (as shown in FIG. 1B) so that the sleeves 14 conform to and lie flat against the wearer's face. However, the sleeves 14 may also take on any other shape that allows the sleeves 14 to securely attach to the temples 16 of the protective eyewear 12. For instance, the sleeves 14 may be cylindrical, oval, circular, triangular, square, or diamond shaped. The sleeves 14 may have any width or length sufficient to receive the temple 16 of the protective eyewear 12 and to provide a secure connection. Though, as will be apparent to one of ordinary skill in the art, the width of the sleeves 14 should be sized to the thickness of the temples 16 of the protective eyewear 12 to be used so that the temples 16 can slide in and out of the sleeves 14.

While the sleeves 14 have been described herein as an exemplary attachment mechanism, it will be readily apparent to one of ordinary skill in the art that the mask piece 10 may be attached to the protective eyewear 12 by other attachment mechanisms including, but not limited to, clips, magnets, hook and loop fasteners, snap fasteners, adhesives, and pressure fit connections. For example, the mask piece 10 may include a pair of cylindrically shaped foam or silicone attachments (not shown) having a slit for hooking or locking onto the temples 16 of the protective eyewear 12. In another embodiment, the mask piece 10 may include one or more clips (not shown) that attach onto the temples 16 of the protective eyewear 12. For instance, the one or more clips may be made from a malleable or pliable material that allows for the one or more clips to hook or form onto the temples 16. In still another embodiment, the mask piece 10 may attach to types of protective eyewear 12 having integrally formed or removably attached side shields (such as goggles). In this embodiment, the mask piece 10 may attach to the side shields of the protective eyewear 12 using hook and loop fasteners or magnets. In yet another embodiment, the mask piece 10 may include a fabric fastener configured to loop around each temple 16 of the protective eyewear 12. In still other embodiments, the temples 16 of the protective eyewear 12 may include a slit for inserting a portion of the mask piece 10 therein.

The mask piece 10 may be made from one or more layers of a material that reduces the transmission of infectious airborne particles to and from the wearer of the face covering 100. In one embodiment, the mask piece 10 may be made from a fibrous material. Examples of suitable fibrous materials include, but are not limited to, cotton, wool, silk, polyester, neoprene, cellulosic fiber, glass fiber, mineral fibers, nylon fiber, acrylonitrile fiber, spandex, and combinations thereof. The mask piece 10 may be also be made from heat-moldable fabric laminate layers of a nonwoven material. Examples of such fabric include, but are not limited to, spunbond nonwoven polypropylene fiber (SBPF) (also called spunbonded nonwoven polypropylene) and melt blown polypropylene fiber (MBPF). In one embodiment, the heat-moldable fabric may include a spunbond/melt blown fiber composite comprising alternating spunbond (S) and melt blown layers (M), such as for example MS, SM, SMS, SSMS, SMSS, SMSMS, SMMSS and SSMMS. In other embodiments, the mask piece 10 may be formed of a transparent plastic material. As used herein, "transparent" refers to any material which permits a sufficient amount of visible light to pass therethrough. The mask piece 10 may be made from a transparent plastic such as polyethylene, polypropylene, polycarbonate, acrylic, or PETG. For example, the mask piece 10 may include a transparent plastic panel generally disposed in the center of the mask piece 10 to allow for the mouth and adjacent portions of the face to be seen when the mask is worn so that others can discern the facial expressions and lip movements of the wearer. In some embodiments, a non-fogging or fog-resistant coating may be applied to such plastic materials. Examples of suitable non-fogging or fog-resistant coatings include, but are not limited to, silicone coatings and flouro-chemical coatings. As will be readily understood by one of ordinary skill in the art, any combination of the above-described materials may be used for forming the mask piece 10. For instance, the mask piece 10 may be formed from one or more layers of fibrous or fabric layer and one or more layers of transparent plastic.

The mask piece 10 may also include one or more antimicrobial agents. The antimicrobial agents may be present on the exterior and/or interior of the mask piece 10. Suitable antimicrobial agents include, but are not limited to, biquanide, isothiazolones, metals, alcohols, silver-loaded zeolites, phenol or phenol derivatives such as short chain alkyl esters of p-hydroxybenzoic acid, commonly known as parabens; N-(4-chlorophenyl)-N'-(3,4-dichlorophenyl) urea, also known as 3,4,4'-trichlorocarbanilide or triclocarban; 2,4,4'-trichloro-2'-hydroxy diphenyl ether, commonly known as triclosan, ammoniums (for example, bacteriostatic quaternary ammonium compounds such as benzalkonium chloride, benzethonium chloride, cetyl pyridium chloride, lauryl pyridium chloride and methyl benzethonium chloride); zinc phenol sulfonate; zinc ricinoleate; triethyl citrate; chitosan or chitin derivatives and combinations thereof. In one embodiment, the antimicrobial agent is selected from the group consisting of biquanides, phenols, phenol derivatives, isothiazolones, metals, ammoniums, alcohols and combinations thereof.

The mask piece 10 may further include one or more antiviral agents. The antiviral agents may be present on the exterior and/or interior of the mask piece 10. Suitable antiviral agents include, but are not limited to, oseltamivir phosphate, zanamivir, peramivir, baloxavir marboxi, amantadine, rimantadine, and combinations thereof. In one embodiment, the antiviral agent is selected from the group consisting of oseltamivir phosphate, zanamivir, peramivir, baloxavir marboxi, and combinations thereof.

The mask piece 10 may formed of any number of layers of any combination of the materials described above. In one embodiment, the mask piece 10 is formed of at least one layer of materials. In another embodiment, the mask piece 10 is formed of at least two layers of material. In still another embodiment, the mask piece 10 is formed of at least three layers of material. In yet another embodiment, the mask piece 10 is formed of at least four layers of material.

Figure 2A:
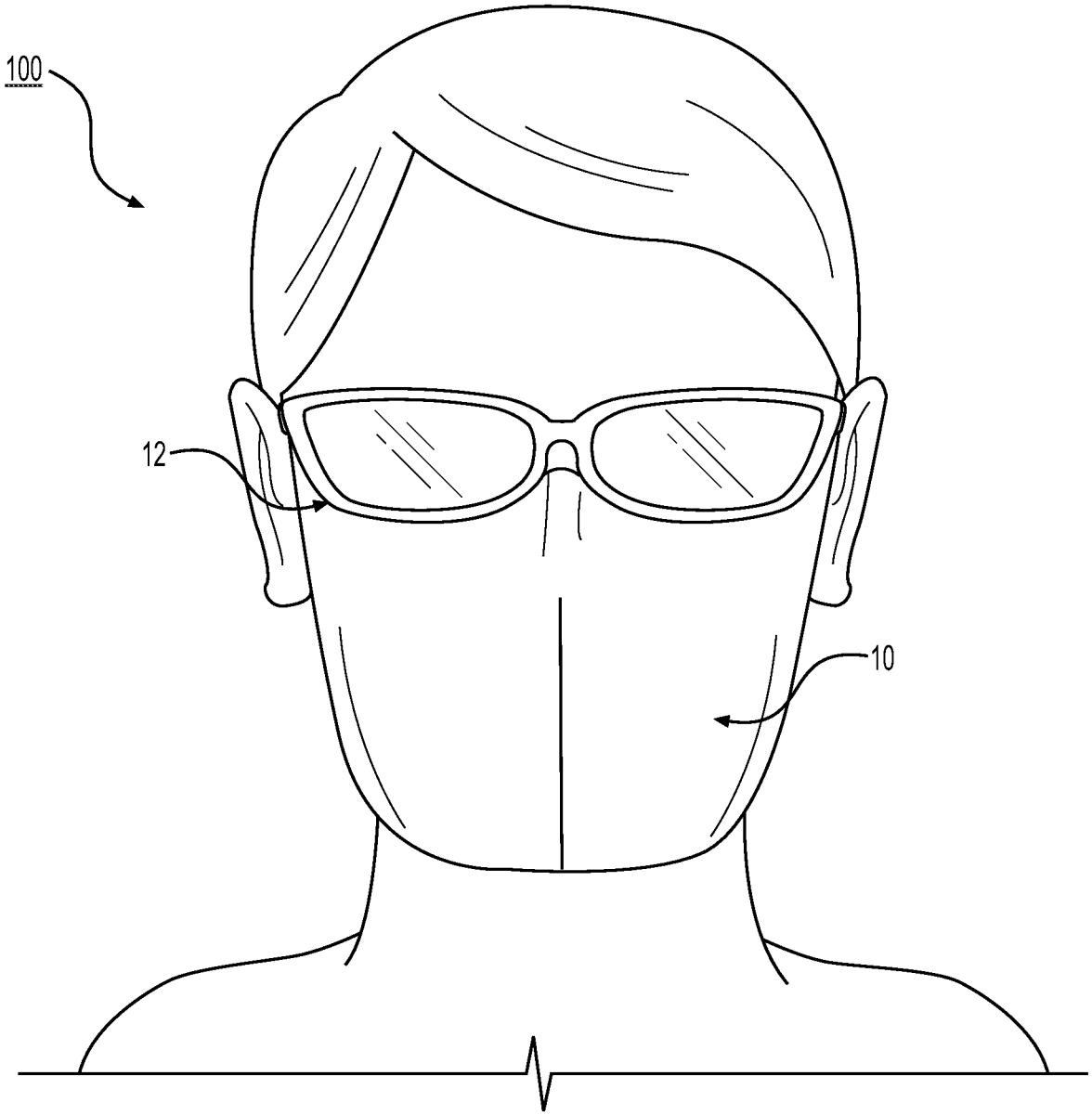
FIG. 2A is a front view of the face covering according to another embodiment of the present disclosure.
Figure 2B:
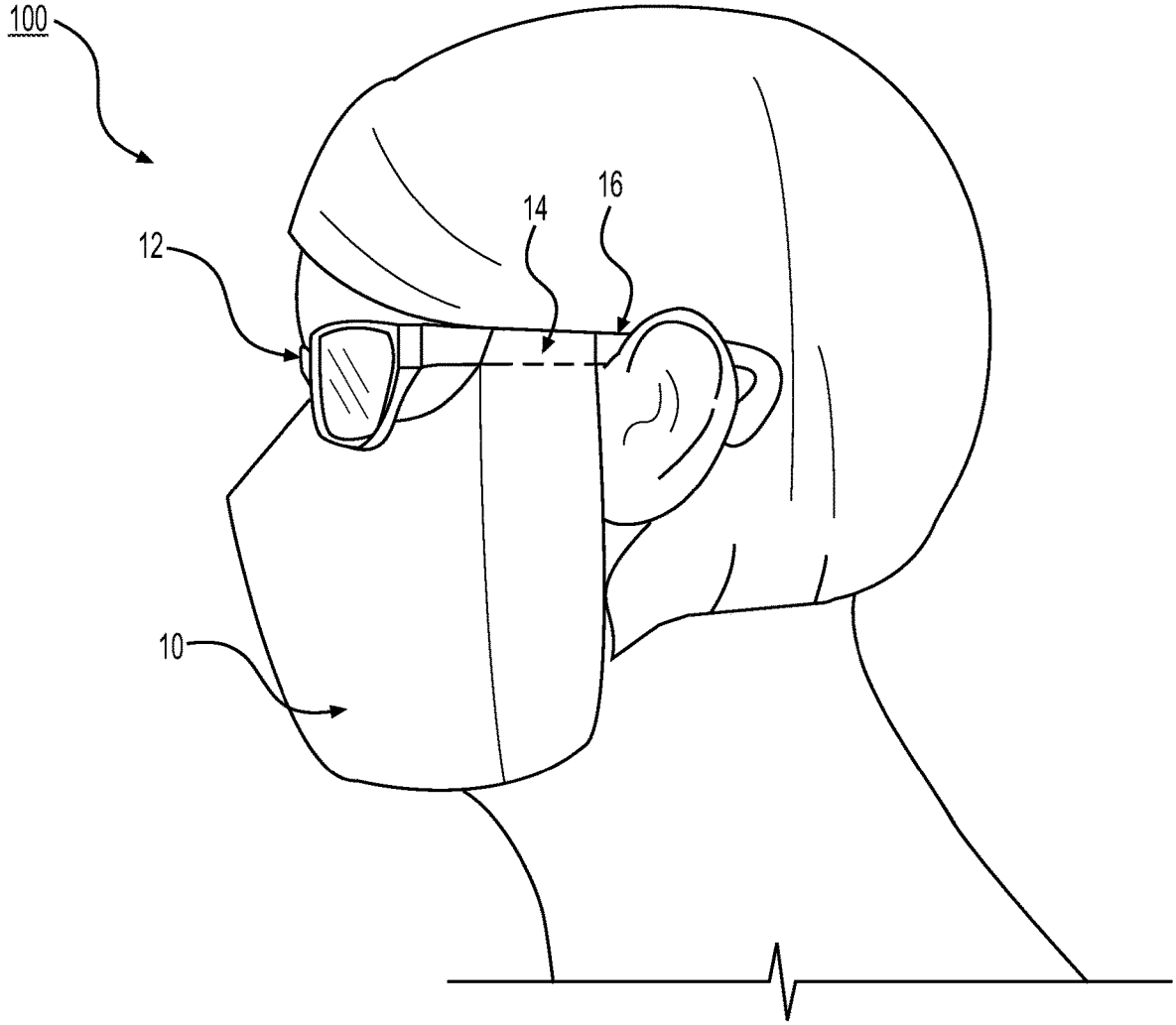
FIG. 2B is a side view of the face covering shown in FIG. 2A.

FIGS. 2A and 2B are front and side views, respectively, of the face covering 100 according to another embodiment of the present disclosure. As shown in FIGS. 2A and 2B, the mask piece 10 may be converted from the free-hanging configuration (as shown in FIGS. 1A and 1B) to a cup-shaped configuration in which the mask piece 10 is folded under the chin of the wearer to create a protective seal around the nose and mouth. In the illustrated embodiment, the mask piece 10 is secured to the temples 16 of the protective eyewear 12 via the sleeves 14 and forms a cup-shaped seal around the wearer's nose, mouth, and chin. As will be described in more detail below, the wearer may convert the mask piece 10 between the free-hanging configuration (shown in FIGS. 1A and 1B) and the cup-shaped configuration (shown in FIGS. 2A and 2B) through the use of a releasable securing means.

Figure 3:
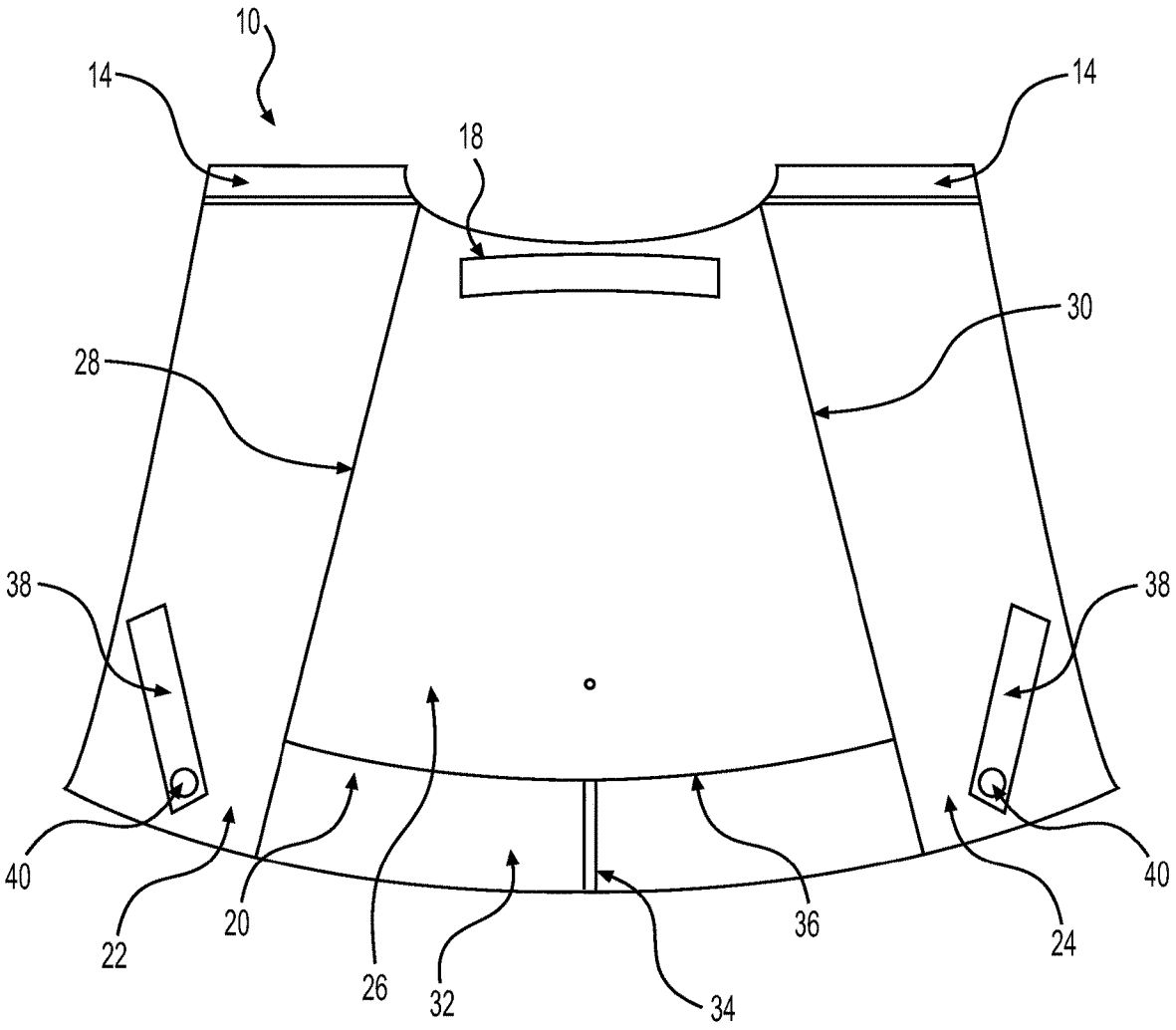
FIG. 3 is an interior view of a mask piece according to one embodiment of the present disclosure.

FIG. 3 shows an interior view of the mask piece 10 according to one embodiment of the present disclosure. As used herein, the "interior" of the mask piece 10 refers to the side of the mask piece 10 that contacts the wearer's face. As shown in FIG. 3, the mask piece 10 may be divided into segments by one or more seams to assist the wearer in converting the face covering 100 from the free-hanging position (as shown in FIGS. 1A and 1B) to the cup-shaped configuration (as shown in FIGS. 2A and 2B). In the illustrated embodiment, the mask piece 10 includes a first side panel 22, a second side panel 24, and a center panel 26. A first seam 28 separates the first side panel 22 from the center panel 26, while a second seam 30 separates the second side panel 24 from the center panel 26. The first and second seams 28 and 30 help to maintain the shape and structure of the mask piece 10 when in the cup-shaped configuration. The center panel 26 includes a pleated portion 32 designed to fold under the chin of the wearer. The pleated portion 32 may include a middle seam 34 in the material to help maintain the rounded, cup-shaped configuration shown in FIG. 2A.

In one embodiment, the wearer may convert the mask piece 10 from the free-hanging configuration to the cup-shaped configuration by folding the pleated portion 32 of the center panel 26 under the wearer's chin along fold line 36. The wearer may then fold each of the first side panel 22 and the second side panel 24 over the pleated portion 32 to bundle the mask piece 10 under the chin. The first side panel 22 and the second side panel 24 may be operably secured to each other to provide a secure fit. In the illustrated embodiment, the first side panel 22 and the second side panel 24 may each include a pocket 38 having a magnetic element 40 embedded therein such that, when each of the first and second side panels 22, 24 are folded over the pleated portion 32, the first side panel 22 and the second side panel 24 are held in a releasably coupled arrangement due to the magnetic attraction. The magnetic attraction advantageously provides a protective and sealed fit around the nose, mouth, chin, and cheeks of the wearer that can easily be undone when the wearer would like to convert the mask piece 10 back to the free-hanging position or remove the mask piece 10.

However, as will be readily apparent to one of ordinary skill in the art, the first and second side panels 22, 24 may be secured by other releasable means, such as by hook and loop fasteners or adhesives. The hook and loop fasteners or adhesives can also provide a protective and sealed fit around the face of the wearer. In this embodiment, the pockets 38 may be replaced with corresponding hook and loop fasteners or adhesives such that, when each of the first and second side panels 22, 24 are folded over the pleated portion 32, the first side panel 22 and the second side panel 24 are held in a releasably coupled arrangement. In still other embodiments, the first and second side panels 22, 24 may be secured through the use of a drawstring or an elastic strap. In this embodiment, the mask piece 10 may include a casing along the bottom portion so that the drawstring or elastic strap may be looped through the casing to form a closed loop. The drawstring or elastic strap may then be tightened as desired to create the cup-shaped configuration shown in FIGS. 2A and 2B. In yet another embodiment, the mask piece 10 may include a pair of holes or slits in the bottom portion of the mask piece 10 (for example, where the pockets 38 are located) and are configured to attach to or loop onto the temples 16 of the protective eyewear 12 (for instance, by inserting the tips of the temples 16 into the holes or slits). In still other embodiments, the mask piece 10 may be bundled under the chin of the wearer through the use of permanent securing means, such as by sewing, threading, or stitching.

In some embodiments, the mask piece 10 may include a nose grip 18. In one embodiment, the nose grip 18 may be in the form of a manually bendable or malleable material such as a soft metallic alloy of lead, zinc, aluminum, thin gauge steel, rubber, silicone, plastic, or combinations thereof. The nose grip 18 may bend readily upon finger manipulation and retains the bend with reasonable stability. The nose grip 18 may be pinched around the bridge of the nose to assure that edges of the mask piece 10 fit reasonably tightly against the face so as to aid in forming a more effective seal against the passage of airborne contaminants. The seal formed by the nose grip 18 can also help to prevent the protective eyewear 12 from fogging. Nose grip 18 may be affixed by stitching, sewing, adhesives, or other fasteners to the upper portion of the interior of the mask piece 10 (as shown in FIG. 3).

The interior of the mask piece 10 may also include a slot 20 for inserting filtration media. For example, any suitable filter with low airflow resistance effective for particulate filtration may be inserted into the slot 20. Suitable filters for particulate filtration may include, but are not limited to, activated carbon (charcoal) filters, high efficiency particulate air (HEPA) filters, PM2.5 filters, and MERV13 or MERV16 filters. In another embodiment, one or more layers of the fibrous or fabric material discussed above may be inserted into the slot 20 to provide additional layers for particulate filtration.

Figure 4A:
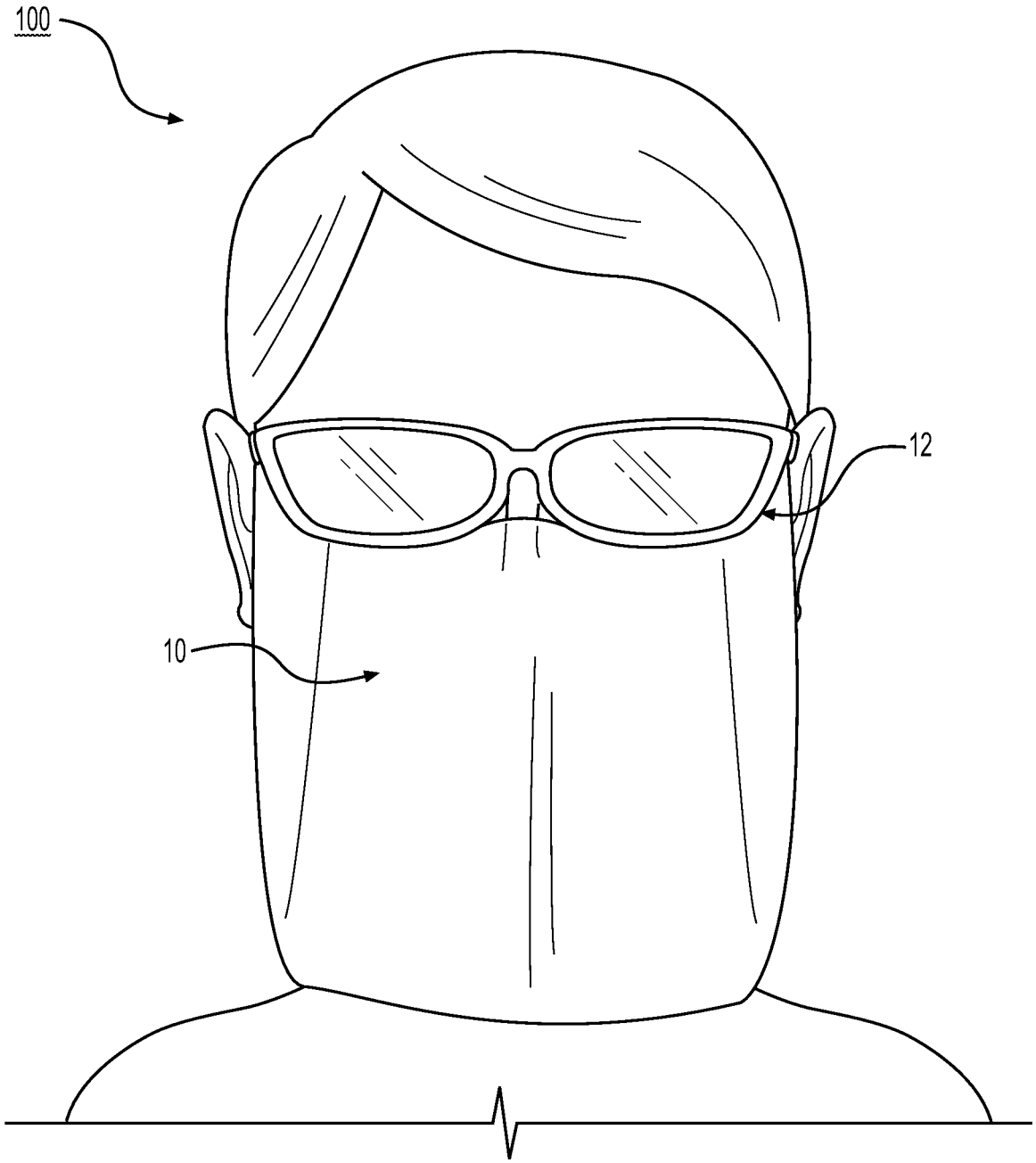
FIG. 4A is a front view of the face covering according to still another embodiment of the present disclosure.
Figure 4B:
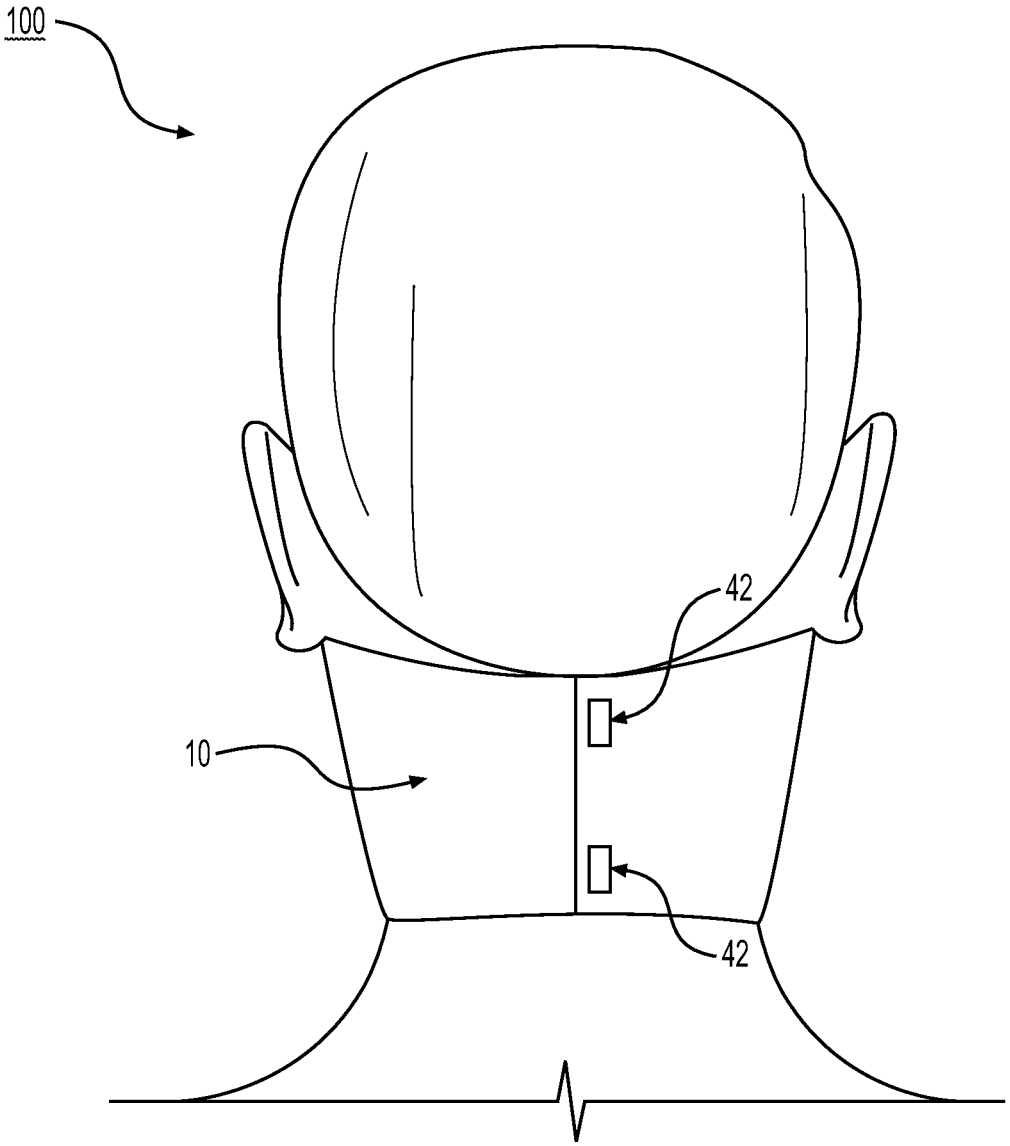
FIG. 4B is a back view of the face covering shown in FIG. 4A.

FIGS. 4A and 4B are front and back views of the face covering 100 according to still another embodiment of the present disclosure. As illustrated in FIGS. 4A and 4B, the face covering 100 may be converted to a configuration in which the mask piece 10 wraps completely around the head of the wearer. In this embodiment, the mask piece 10 can cover the entire face below the protective eyewear 12 as well as the ears and neck of the wearer. This configuration offers maximum protection from harmful airborne particles, while still providing comfort and breathability. Since the mask piece 10 covers the entire face and neck of the wearer, this configuration is also advantageous for protecting the wearer from the sun (for example, from sunburns) and from harsh environments (for example, to guard against sleet and snow, wind burn, and/or rain).

As shown in FIG. 4B, the mask piece 10 includes a sufficient amount of material such that the left and right sides of the mask piece 10 can meet and attach at the back of the wearer's head. In this embodiment, the mask piece 10 may include one or more attachment points 42 for securing the mask piece 10 at the back of the head, as will be described in more detail below.

Figure 5:
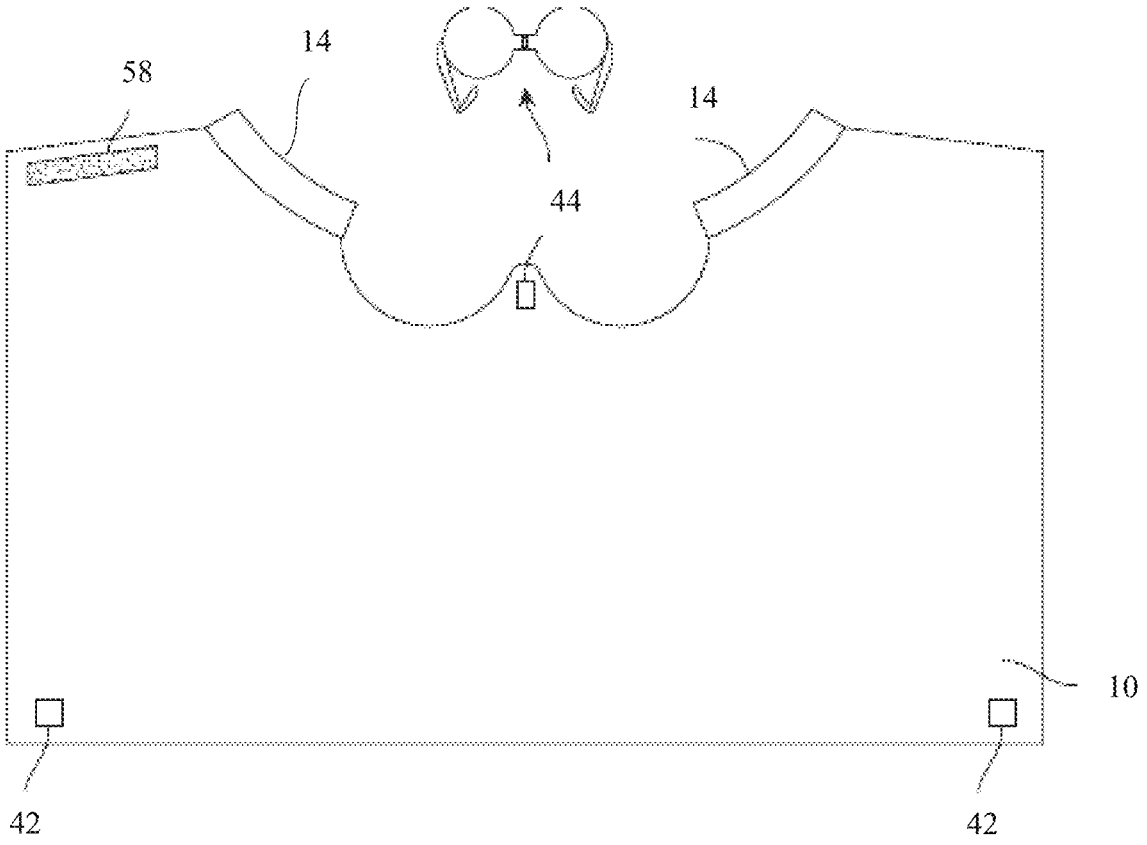
FIG. 5 is an exterior view of the mask piece according to another embodiment of the present disclosure.

FIG. 5 is an exterior view of the mask piece 10 according to another embodiment of the present disclosure. As shown in FIG. 5, the mask piece 10 may include attachment points 42 at the bottom left and right corners of the mask piece 10. In the illustrated embodiment, the attachment points 42 are located on the exterior of the mask piece 10; however, the attachment points 42 may also be located on the interior of the mask piece 10. Additional attachment points may be positioned above attachment points 42 along the left and right sides of the mask piece 10 to provide reinforcement in securing the mask piece 10 behind the head of the wearer. In one embodiment, the attachment points 42 are magnets that may be releasably coupled at the back of the wearer's head by a magnetic attraction. In another embodiment, the attachment points 42 may include corresponding hook and loop or snap fasteners that may be releasably coupled at the back at the wearer's head. In still another embodiment, the attachment points 42 are adhesives, such as pressure sensitive adhesives, that may be releasably coupled. In yet another embodiment, the attachment points 42 may include clips (such as gator clips) that can be releasably coupled to an opposing side of the mask piece 10 or to the wearer's clothing. In another embodiment, the attachment points 42 may include strings or straps that can be tied together at the back of the head.

In some embodiments, the mask piece 10 may include an eyewear coupler 44 to assist in coupling the protective eyewear 12 to the mask piece 10. The eyewear coupler 44 may be positioned at the top portion of the mask piece 10, preferably in the center such that the protective eyewear 12 can be coupled to the mask piece 10 at the bridge of the wearer's nose. In one embodiment, the eyewear coupler 44 may include a magnet for magnetically coupling the protective eyewear 12 to the mask piece 10. In another embodiment, the eyewear coupler 44 may include a snap fastener such that the protective eyewear 12 is coupled to the mask piece 10 by a snap fit mechanism. In still another embodiment, the eyewear coupler 44 may be a hook and loop fastener for coupling the protective eyewear 12 to the mask piece 10. In yet another embodiment, the eyewear coupler 44 may include a fabric fastener configured to loop around the bridge of the protective eyewear 12. While the eyewear coupler 44 has been shown on the mask piece 10 of FIG. 5, it will be apparent to those skilled in the art that the eyewear coupler 44 may also be incorporated on the mask piece 10 shown in other embodiments of the present disclosure.

The mask piece 10 may also include one or more sealing members 58. The sealing member 58 may be attached to or integral with the interior of the mask piece 10. The sealing member 58 reduces or eliminates gaps that may be present between the wearer's nose and cheeks and the upper part of the mask piece 10. The sealing member 58 conforms to a wearer's face to provide a seal between the mask piece 10 and the nose and cheeks of the wearer. This also helps to reduce or eliminate fogging of the protective eyewear 12. As illustrated in FIG. 5, the sealing member 58 can be positioned on the upper portion of the mask piece 10 to reduce any gaps under the eyes of the wearer. However, the sealing member 58 may also be positioned on one or more sides of the mask piece 10. The sealing member 58 may be any type of adhesive. The sealing member 58 may be joined to the mask piece 10 by stitching, heat welding, or adhesive bonding.

Figure 6A:
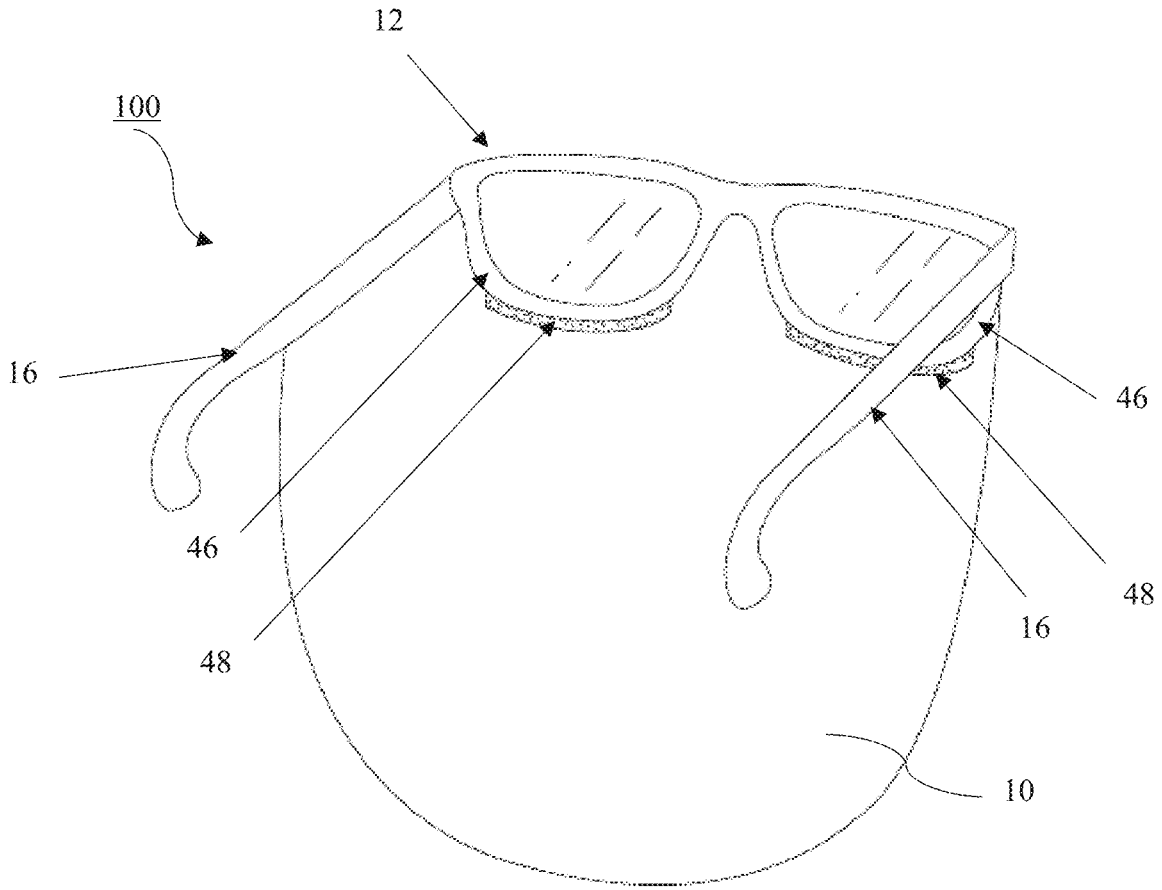
FIG. 6A is a back view of the face covering showing an alternative embodiment by which the mask piece may be attached to eyewear.
Figure 6B:
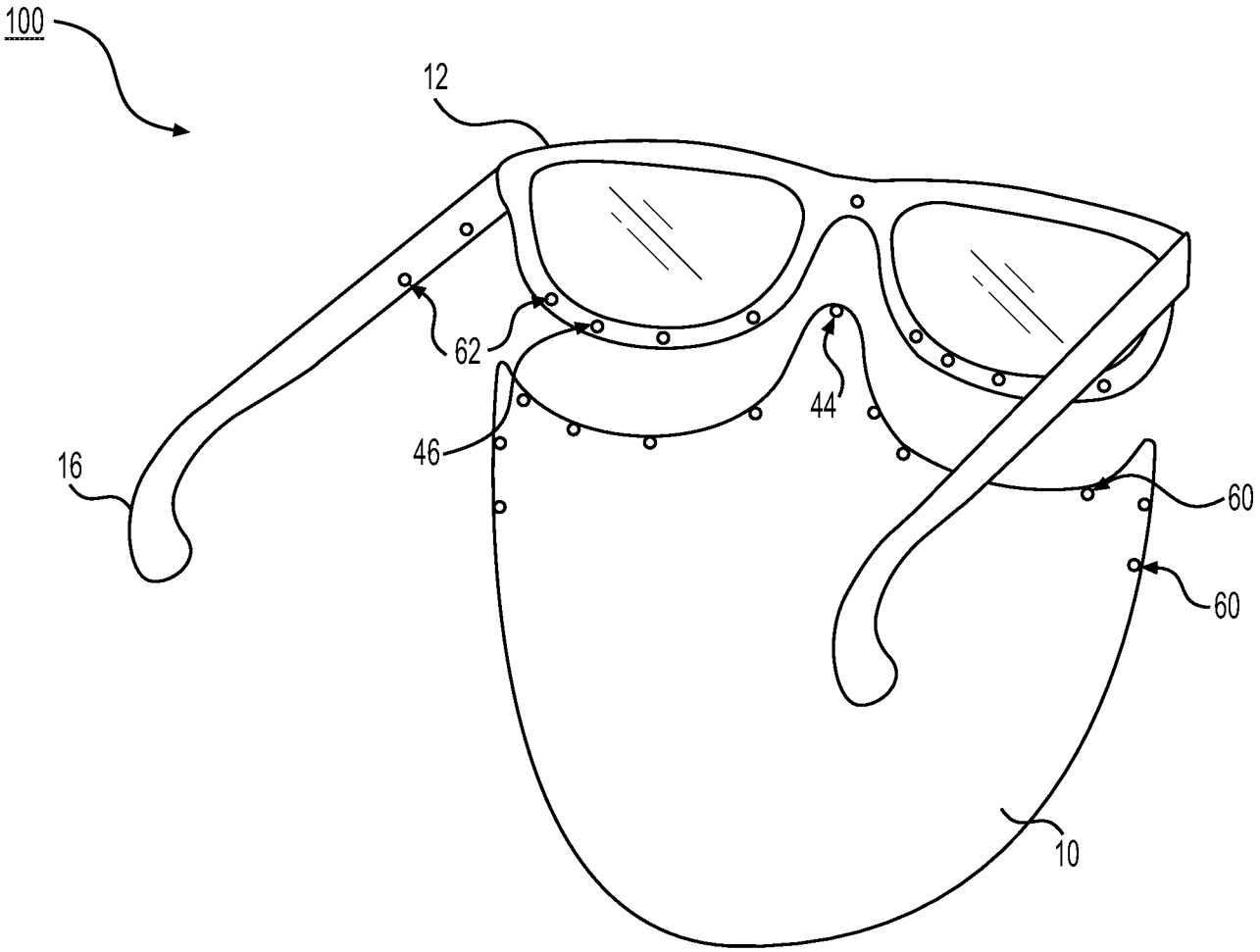
FIG. 6B is a back view of the face covering showing another alternative embodiment by which the mask piece may be attached to eyewear.
Figure 7:
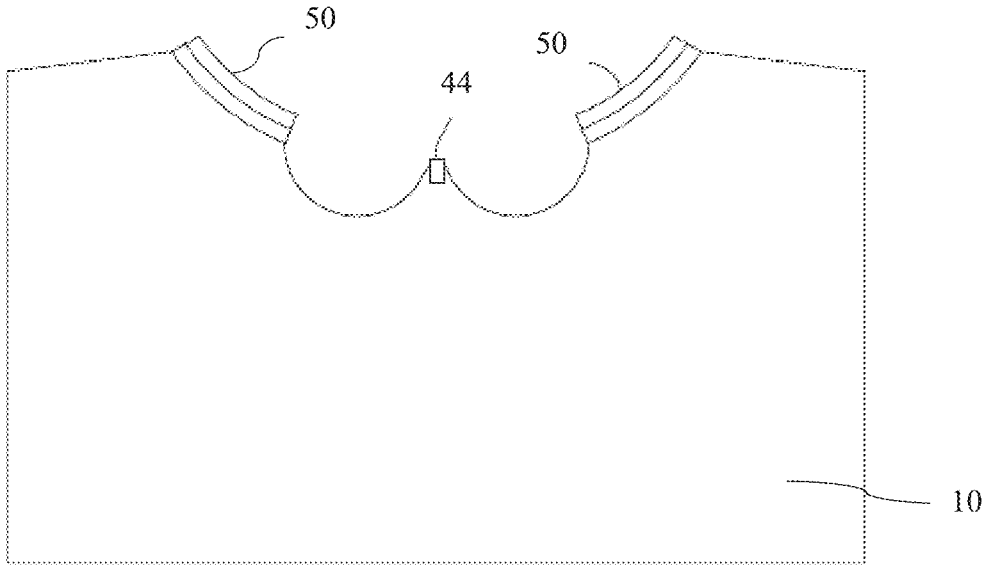
FIG. 7 is an exterior view of the mask piece according to still another embodiment of the present disclosure.

FIGS. 6A, 6B, and 7 show alternative embodiments by which the mask piece 10 may be attached to the protective eyewear 12. In the embodiment illustrated in FIG. 6A, the mask piece 10 can attach to the bottom portions of each of the lens frames 46 of the protective eyewear 12 (rather than to the temples of the eyewear) to create a seamless seal between the protective eyewear 12 and the mask piece 10. In this embodiment, the mask piece 10 may include one or more fasteners configured to releasably couple to the bottom portions of the lens frames 46. For instance, as shown in FIG. 6A, the mask piece 10 may include one or more hook and loop fasteners 48 configured to be releasably coupled to corresponding hook and loop fasteners on the bottom portions of each of the lens frames 46. In another embodiment, as illustrated in FIG. 6B, the mask piece 10 may include one or more magnetic attachments 60 configured to magnetically couple to corresponding magnetic attachments 62 on the bottom portions of each of the lens frames 46 and/or on the protective eyewear 12. For example, the bottom portions of the lens frames 46, the inner or outer portions of the temples 16 of the protective eyewear 12, and/or the bridge of the protective eyewear 12 may include corresponding magnetic fasteners 62 that are configured to releasably couple to the magnetic fasteners 60 on the mask piece 10 to secure the face covering 100 on the wearer. In some embodiments, the corresponding magnetic fasteners 62 may be integrally formed with the bottom portions of the lens frames 46, the inner or outer portions of the temples 16, and/or the bridge of the protective eyewear 12. The magnetic fasteners 60 may be positioned at any location on the upper portion of the mask piece 10 that contacts the lens frames 46 and/or the temples 16 of the protective eyewear 12. The magnetic fasteners may be secured to the mask piece 10 by any suitable securing means, such as by adhesives, sewing, stitching, or threading. Any type of magnetic fastener may be used to secure the protective eyewear 12 to the mask piece 10 (for example, magnetic strips, clasps, snaps, grommets, or neodymium magnets). In this embodiment, the mask piece 10 may also include the eyewear coupler 44 for coupling the bridge of the protective eyewear 12 to the mask piece 10 (for example, by using magnetic attachments).

In the embodiment illustrated in FIG. 7, the mask piece 10 includes a pair of elongated clips 50 configured to attach to the temples 16 of the protective eyewear 12. The pair of elongated clips 50 may hook onto or form over the temples 16 of the protective eyewear 12 to secure the mask piece 10 to the protective eyewear 12. The clips 50 advantageously allow for the wearer to quickly and efficiently attach and remove the mask piece 10 from the protective eyewear 12. Any type of clip 50 may be used to secure the mask piece 10 to the protective eyewear 12 so long as the clip 50 can be securely attached to each of the temples 16. In one embodiment, the clips 50 may be malleable or pliable to allow the clip 50 to fold or form over the temples 16. In another embodiment, the clips 50 may be removably attached to the sleeves 14.

Figure 8A:
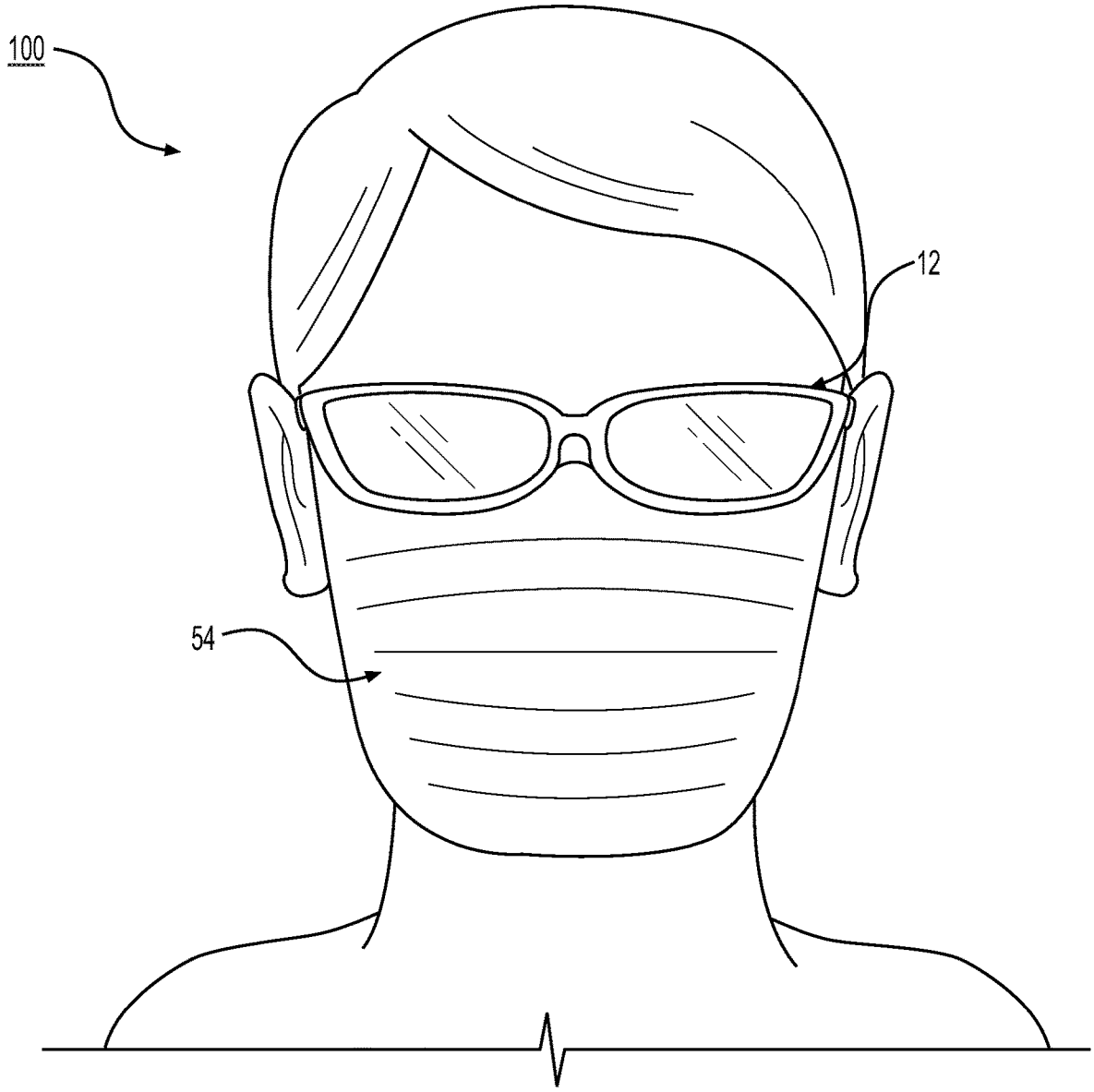
FIG. 8A is a front view of the face covering utilizing a surgical mask according to an alternative embodiment of the present disclosure.
Figure 8B:
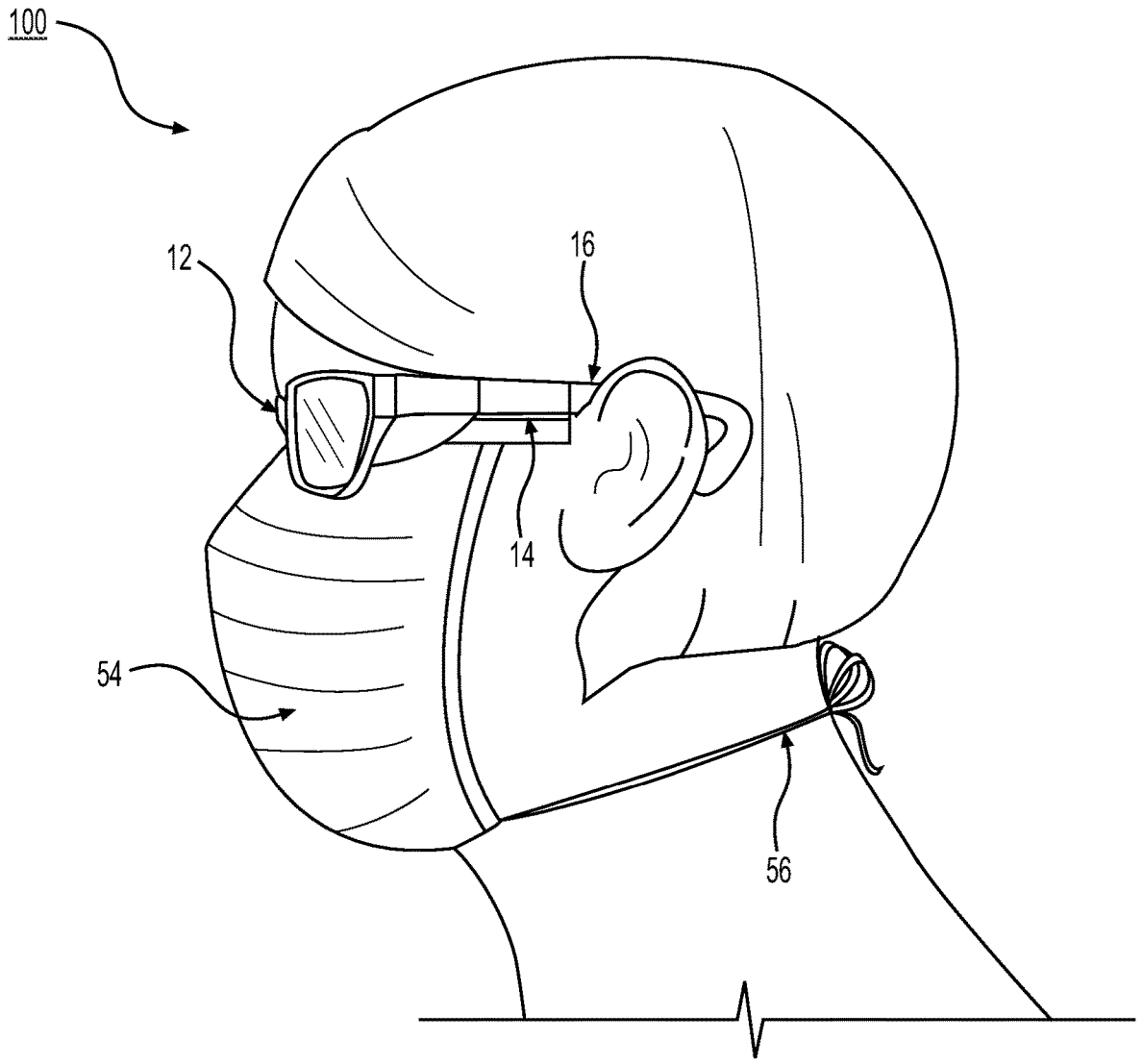
FIG. 8B is a side view of the face covering utilizing the surgical mask shown in FIG. 8A.

FIGS. 8A and 8B are front and side views of the face covering 100 according to an alternative embodiment of the present disclosure. As shown in FIGS. 8A and 8B, the mask piece 10 may be a disposable or washable surgical mask 54. In other embodiments, the mask piece 10 may be an N95, KF94, or KN95 mask. In this embodiment, the surgical mask 54 may include sleeves 14 or clips, as described above, for attaching the surgical mask 54 to the protective eyewear 12. The sleeves 14 or clips can be formed separately and attached to the left and right upper portions of the surgical mask 54. The bottom portion of the surgical mask 54 can be secured to the wearer through the use of one or more strings 56. The wearer may secure the strings 56 together behind the head as tightly or as loosely as desired, while still covering the nose and mouth. The one or more strings 56 may also include a magnet on the end so that the wearer may secure the strings 56 together behind the head through the use of a magnetic attraction.

Figure 9A:
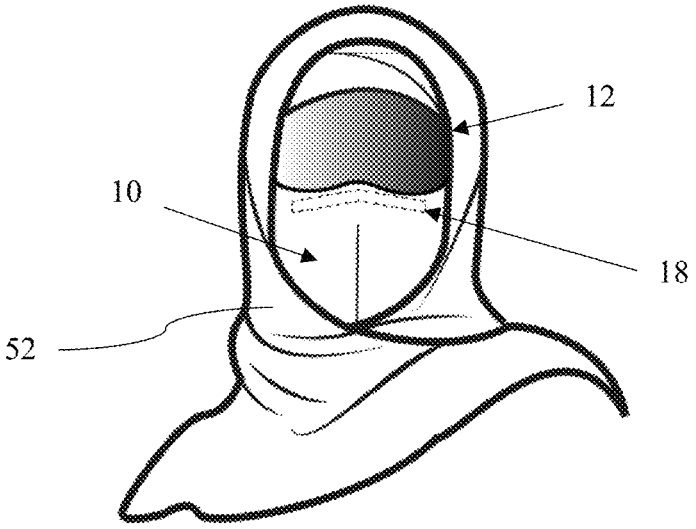
FIG. 9A is a front view of the face covering utilized in combination with a head covering according to one embodiment of the present disclosure.
Figure 9B:
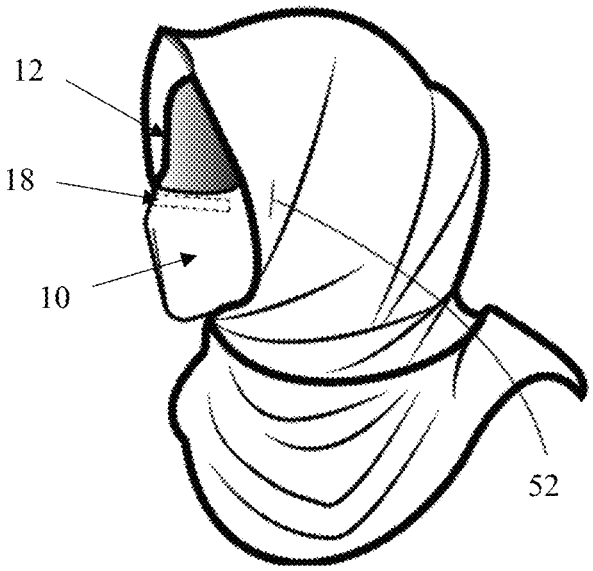
FIG. 9B is a side view of the face covering and head covering shown in FIG. 9A.

In some embodiments, the face covering 100 described herein may be utilized with head pieces and other head coverings, such as niqabs, hijabs, turbans, and any type of hat (such as baseball caps). FIGS. 9A and 9B are front and side views illustrating the use of the face covering 100 with a head covering 52. As illustrated in FIGS. 9A and 9B, the protective eyewear 12 and the mask piece 10 attached thereto can be worn under the head covering 52. In some embodiments, the mask piece 10 can be attached to the head covering 52 to offer increased protection from the transmission of infectious airborne particles. For example, as shown in FIG. 9B, at least one side of the head covering 52 may be stitched to the mask piece 10 at seam 28 or 30 to provide a more thorough and complete seal from the airborne particles. In one embodiment, to provide an ideal fit and offer maximum comfortability, the head covering 52 can be stitched to the seam 28 or 30 at any point about 1.5 inches to about 3 inches below the top edge of the mask piece 10. In another embodiment, the head covering 52 may be stitched to the seam 28 or 30 at any point about 2 inches below the top edge of the mask piece 10. In still other embodiments, at least one side of the head covering 52 may include one or more hook and loop fasteners (not shown) configured to fasten to corresponding hook and loop fasteners on the mask piece 10, for example, at seam 28 or 30. In yet another embodiment, rather than attaching to the mask piece 10, the head covering 52 may attach to the protective eyewear 12 only. For example, the head covering 52 may attach directly to the protective eyewear 12 by any suitable attachment mechanism (for example, magnets, hook and loop fasteners, clips, or adhesives). While FIGS. 9A and 9B illustrate attachment of the mask piece 10 to the head covering 52, one of ordinary skill in the art would readily understand that the mask piece 10 may also attach to any type of hat (such as a baseball cap) using similar mechanisms to those described above.

The face coverings described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the face coverings in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention(s) set forth herein.

What is claimed is:

1. A protective face covering, comprising:

a mask piece adapted to cover a user's nose, mouth, and chin, wherein the mask piece is formed of a flexible material and the mask piece comprises:

a first side panel, a second side panel, and a center panel comprising a pleated portion;

a first attachment mechanism configured to attach the mask piece to an eyewear having a first temple and a second temple, wherein the first attachment mechanism comprises at least one of: a pair of sleeves configured for receiving each temple of the eyewear and a pair of clips configured for hooking onto each temple of the eyewear, wherein the pair of sleeves and the pair of clips are directly coupled to the mask piece; and a second attachment mechanism comprising a first magnetic element in a bottom portion of the first side panel and a second magnetic element in a bottom portion of the second side panel, wherein the pleated portion is configured to fold under the user's chin and the first side panel and the second side panel are each configured to fold over the pleated portion in a releasably coupled arrangement under the user's chin to create a sealed fit around the user's nose, mouth, and chin, wherein the mask piece is configured to extend continuously from the eyewear to below the user's chin.

2. The protective face covering of claim 1, wherein the mask piece further comprises an eyewear coupler, the eyewear coupler configured to couple the eyewear to the mask piece.

3. The protective face covering of claim 1, wherein the mask piece is formed of a material selected from a group consisting of cotton, wool, silk, polyester, neoprene, cellulosic fiber, glass fiber, mineral fibers, nylon fiber, acrylonitrile fiber, plastic, spunbond nonwoven polypropylene fiber (SBPF), melt blown polypropylene fiber (MBPF), and combinations thereof.

4. The protective face covering of claim 1, wherein the mask piece comprises at least one of: an antimicrobial agent selected from a group consisting of biquanides, phenols, phenol derivatives, isothiazolones, metals, ammoniums, alcohols, and combinations thereof, and an antiviral agent selected from a group consisting of oseltamivir phosphate, zanamivir, peramivir, baloxavir marboxi, amantadine, rimantadine, and combinations thereof.

5. A protective face covering, comprising:

a mask piece adapted to cover a user's nose, mouth, and chin, wherein the mask piece is formed of a flexible material and the mask piece comprises:

a first side panel, a second side panel, and a center panel comprising a pleated portion;

a first attachment mechanism configured to attach the mask piece to a left temple and a right temple of an eyewear, wherein the first attachment mechanism comprises a first sleeve directly coupled to a top edge of the first side panel and a second sleeve directly coupled to a top edge of the second side panel, the first and second sleeves configured for receiving each temple of the eyewear; and a second attachment mechanism configured to releasably couple the mask piece around the user's chin, wherein the second attachment mechanism comprises a first magnetic element in a bottom portion of the first side panel and a second magnetic element in a bottom portion of the second side panel, wherein the pleated portion is configured to fold under the user's chin and the first side panel and the second side panel are each configured to fold over the pleated portion in a releasably coupled arrangement under the user's chin to create a sealed fit around the user's nose, mouth, and chin, wherein the mask piece is configured to extend continuously from the eyewear to below the user's chin.

6. The protective face covering of claim 5, wherein the mask piece further comprises a bendable nose grip.

7. The protective face covering of claim 5, wherein the mask piece has an interior surface, the interior surface comprising a slot configured for insertion of a filter selected from an activated carbon filter, a high efficiency particulate air (HEPA) filter, or a combination thereof.

8. The protective face covering of claim 5, wherein the mask piece is formed of at least one layer of a material selected from a group consisting of cotton, wool, silk, polyester, neoprene, cellulosic fiber, and combinations thereof.

9. The protective face covering of claim 5, wherein the mask piece further comprises an eyewear coupler, the eyewear coupler comprising a magnet for magnetically coupling the eyewear to the mask piece.

10. The protective face covering of claim 5, wherein the mask piece is formed of a transparent plastic material selected from a group consisting of polyethylene, polypropylene, polycarbonate, acrylic, and PETG.

11. The protective face covering of claim 10, wherein the transparent plastic material comprises a fog-resistant coating.

12. A protective face covering, comprising:

an eyewear adapted for protecting a user's eyes, wherein the eyewear comprises a left temple, a right temple, a bridge, and at least one lens frame;

a mask piece adapted to cover the user's nose, mouth, and chin, wherein the mask piece is formed of a flexible material and the mask piece comprises:

a first side panel, a second side panel, and a center panel, wherein the center panel comprises a pleated portion configured to fold under the user's chin;

a first attachment mechanism configured to attach the mask piece to the left temple, the right temple, the bridge, the at least one lens frame, or any combination thereof, wherein the first attachment mechanism comprises a fastener configured to couple to a corresponding fastener on the left temple, the right temple, the bridge, the at least one lens frame, or any combination thereof, wherein the fastener is directly coupled to a top edge of the mask piece; and a second attachment mechanism configured to releasably couple the mask piece under the user's chin, wherein the second attachment mechanism comprises a first magnetic element in a bottom portion of the first side panel and a second magnetic element in a bottom portion of the second side panel, and wherein the first side panel and the second side panel are each configured to fold over the pleated portion in a releasably coupled arrangement under the user's chin to create a sealed fit around the user's nose, mouth, and chin, wherein the mask piece is configured to extend continuously from the eyewear to below the user's chin.

13. The protective face covering of claim 12, wherein the center panel of the mask piece further comprises a nose grip.

14. The protective face covering of claim 12, wherein the fastener and the corresponding fastener comprise a magnet or a hook and loop fastener.

* * * * *